United States Patent [19]

Itoh et al.

[11] Patent Number: 4,755,821

[45] Date of Patent: Jul. 5, 1988

[54] PLANAR ANTENNA WITH PATCH RADIATORS

[75] Inventors: Kiyohiko Itoh, Sapporo; Kazutaka Hidaka, Yokohama, both of Japan

[73] Assignee: Kabushiki Kaisha Toshiba, Kawasaki, Japan

[21] Appl. No.: 886,676

[22] Filed: Jul. 18, 1986

[30] Foreign Application Priority Data

Jul. 19, 1985 [JP] Japan ..... 60-158366

[51] Int. Cl.[4] ..... H01Q 00/00

[52] U.S. Cl. ..... 343/700 MS; 343/770; 343/771

[58] Field of Search ..... 343/700 MS, 770, 771, 343/767

[56] References Cited

U.S. PATENT DOCUMENTS

| | | | |
|---|---|---|---|
| 2,479,209 | 8/1949 | Chu | 343/771 |
| 4,213,133 | 7/1980 | Hidaka | 343/814 |
| 4,518,965 | 5/1985 | Hidaka | 343/742 |
| 4,686,537 | 8/1987 | Hidaka et al. | 343/786 |

FOREIGN PATENT DOCUMENTS

| | | | |
|---|---|---|---|
| 0123206 | 7/1983 | Japan | 343/767 |
| 1502943 | 3/1978 | United Kingdom | 343/770 |

OTHER PUBLICATIONS

IEEE Trans. Antennas Propagation, vol. AP-33, No. 12, pp. 1347-1353, "A Radial Line Slot Antenna for, 12 GHz Satellite TV Reception", Dec. 1985.

Microwave Journal, vol. 27, No. 7, pp. 147-149, "mm--Wave Oversized Cavity Slotted Array", Jul. 1984.

Antenna Engineering Handbook, Chap. 7, "Microstrip Antennas", McGraw-Hill Book Company, 1984.

National Convention Record, 1985 the Institute of Electronics and Communication Engineers of Japan, pp. 3-279, "Experiments on a Radial Line Antenna" Mar. 5, 1985.

*Primary Examiner*—William L. Sikes

*Assistant Examiner*—Hoanganh Le

*Attorney, Agent, or Firm*—Oblon, Fisher, Spivak, McClelland & Maier

[57] ABSTRACT

A planar antenna includes a first slotted waveguide serving as a power-feed unit, and a second slotted waveguide of planar type coupled with the power-feed waveguide, for radiating circularly polarized microwaves into space. The second waveguide has a metal plate in which a two-dimensional slot array consisting of a plurality of rows of slots is formed. An insulative layer is provided on the second waveguide to cover the slot array. A plurality of rows of metal patch radiators are provided on the insulative layer. These patch radiators are electromagnetically coupled with the slots, respectively, in such a manner that each radiator is directly excited by the corresponding slot through the insulative layer, thereby radiating circularly polarized microwaves.

8 Claims, 6 Drawing Sheets

PLANAR ANTENNA WITH PATCH RADIATORS

BACKGROUND OF THE INVENTION

The present invention relates to a planar antenna and, more particularly, to a planar antenna having plate-shaped radiators excited by narrow slots cut in a waveguide to radiate microwaves into space.

A microwave antenna using a parabolic reflector is in widespread use as a ground antenna for transmitting and receiving microwaves in satellite broadcasting. However, this antenna has a large-scaled parabolic reflector, and is easily influenced by weather conditions (e.g., snow, wind, and the like).

A planar antenna is free from the above-mentioned problems, and can be efficiently installed on the ground without requiring a large space, since it does not require any large reflector like the parabolic antenna. Therefore, the use of a planar antenna has been proposed for use as a ground antenna for transmitting and receiving microwaves in satellite broadcasting. Planar antennas include various types of antennas. For example, in a slot antenna, a plurality of slot arrays formed on the upper plate of a wide, thin substrate are excited by feed wire lines (or microstrip lines) and radiate microwaves from radiators. A planar type slot array antenna of this type is well known to the skilled in the art.

Since the planar type slot antenna has a main part constituted by a relatively thin substrate, it is not easily influenced by the weather conditions, and can be easily installed on the ground. However, the aperture efficiency of this antenna is lower than that of a parabolic antenna. The low aperture efficiency is caused by high dielectric and conductor losses since power is fed to the radiatiors through relatively long microstrip lines.

As a recent planar type slot antenna with an improved aperture efficiency, a radial slot antenna for 12-GHz satellite TV reception is described in IEEE TRANSACTIONS ON ANTENNAS AND PROPAGATION. VOL. AP-33, NO. 12, December 1985, pp. 1347–1353. With this slot antenna, since a circular waveguide is used in place of wire lines for feeding power to radiators, the dielectric and conductor losses can be minimized, thereby improving the effective aperture efficiency. However, a slot antenna of this type is still unsuitable for a ground antenna for transmitting and receiving microwaves in satellite broadcasting. This is because grating lobes cannot be prevented from occurring in a radiation pattern of a circularly polarized microwave from radiators formed of a number of pairs of narrow slots, which are aligned on a circular-shaped waveguide in a spiral form and each pair of which has two slots arranged in a "T" or "L" shape manner. This results in a poor directivity of the antenna. In order to eliminate the above problem using the antenna structure described in the above reference, an additional circuit (e.g., a slow-wave circuit) must be necessary, resulting in a complicated structure of the slot antenna.

SUMMARY OF THE INVENTION

It is therefore an object of the present invention to provide a new and improved planar antenna which has a high aperture efficiency and which can minimize the generation of grating lobes in a radiation pattern, without any additional circuitry such as the slow-wave circuit, to thereby radiate circularly polarized microwaves with excellent directivity.

In accordance with the above object, the present invention is addressed to a specific planar antenna which includes a feeder unit for sending microwave and an antenna unit for radiating a circularly polarized wave out into space. The feeder unit has a first slotted waveguide, while the antenna unit includes a second slotted waveguide coupled with said first slotted waveguide. The second slotted waveguide is provided to have a conductive plate in which a two-dimensional slot array including a plurality of rows of slots is formed. An insulative layer is provided on the first conductive plate to cover the two-dimensional slot array. A plurality of rows of plate-shaped radiators are provided on the insulative layer. These plate-shaped radiators are electromagnetically coupled with the slots, respectively, in such a manner that each radiator is directly excited by the corresponding slot through the insulative layer to thereby radiate a circularly polarized microwave.

The invention, and its objects and advantages, will become more apparent in the detailed description of a preferred embodiment as presented below.

BRIEF DESCRIPTION OF THE DRAWINGS

In the detailed description of the preferred embodiments of the invention as presented below, reference is made to the accompanying drawings in which.

DETAILED DESCRIPTION OF THE PREFERRED EMBODIMENTS

Figure 1:
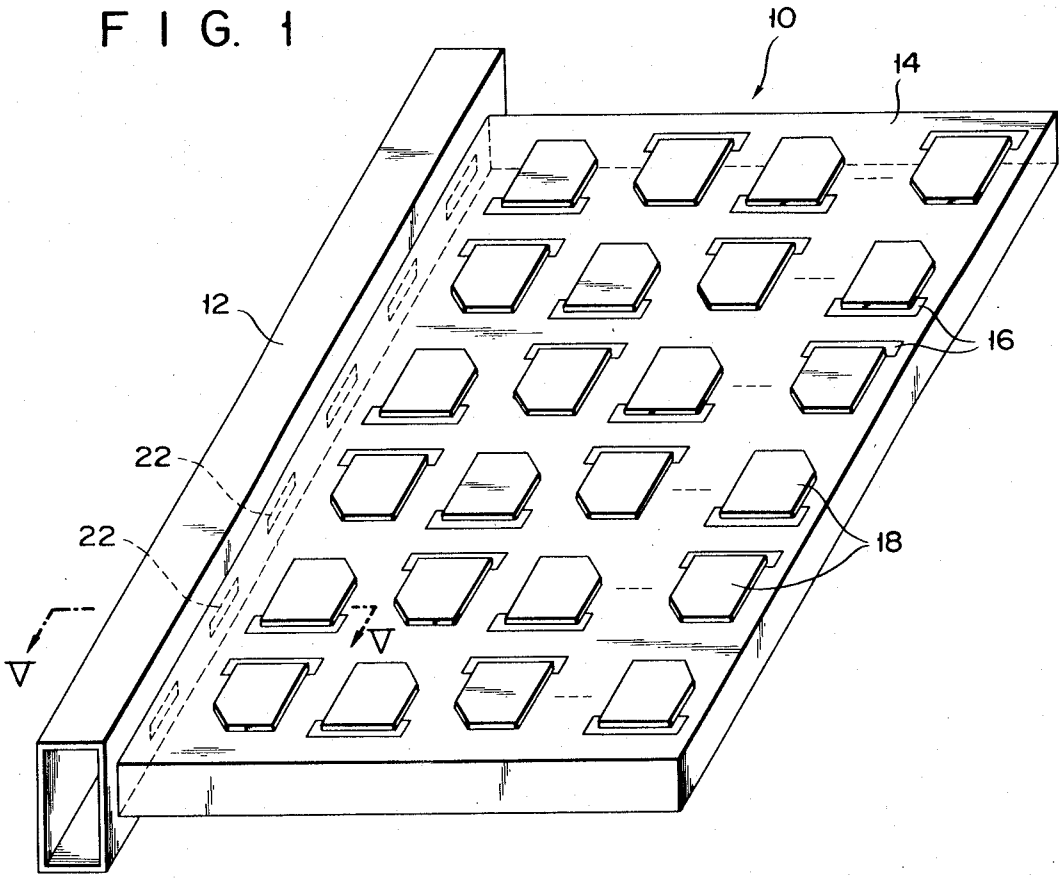
FIG. 1 is a perspective view of a planar antenna with radiator arrays formed on a wide rectangular waveguide for radiation/reception of microwaves, in accordance with a first embodiment of the invention.

There is shown in FIG. 1 of the drawings a planar type microwave antenna structure with arrays of plate-shaped radiators for radiation/reception of circularly polarized microwaves, which is designated generally by the numeral 10. This antenna 10 has a rectangular slotted waveguide 12 for transmission of microwave electromagnetic energy through its interior.

Waveguide 12 serves as a power-feed waveguide in this antenna 10, and is coupled to planer waveguide 14 serving as a radiator array waveguide. A plurality of rows of narrow slots 16 are formed in a matrix in the upper conductive (metallic) plate of array waveguide 14. In practice, the slots 16 are narrow openings or windows cut in the upper plate of waveguide 14. However, FIG. 1 illustrates slots 16 as if they were elongated rectangular areas on the plate, for the sake of simplicity. Metal plates (to be referred to as "patch plates" or "patch radiators" hereinafter) 18 for radiating and receiving circularly polarized microwaves are respectively arranged on slots 16 of array waveguide 14.

Figure 2:
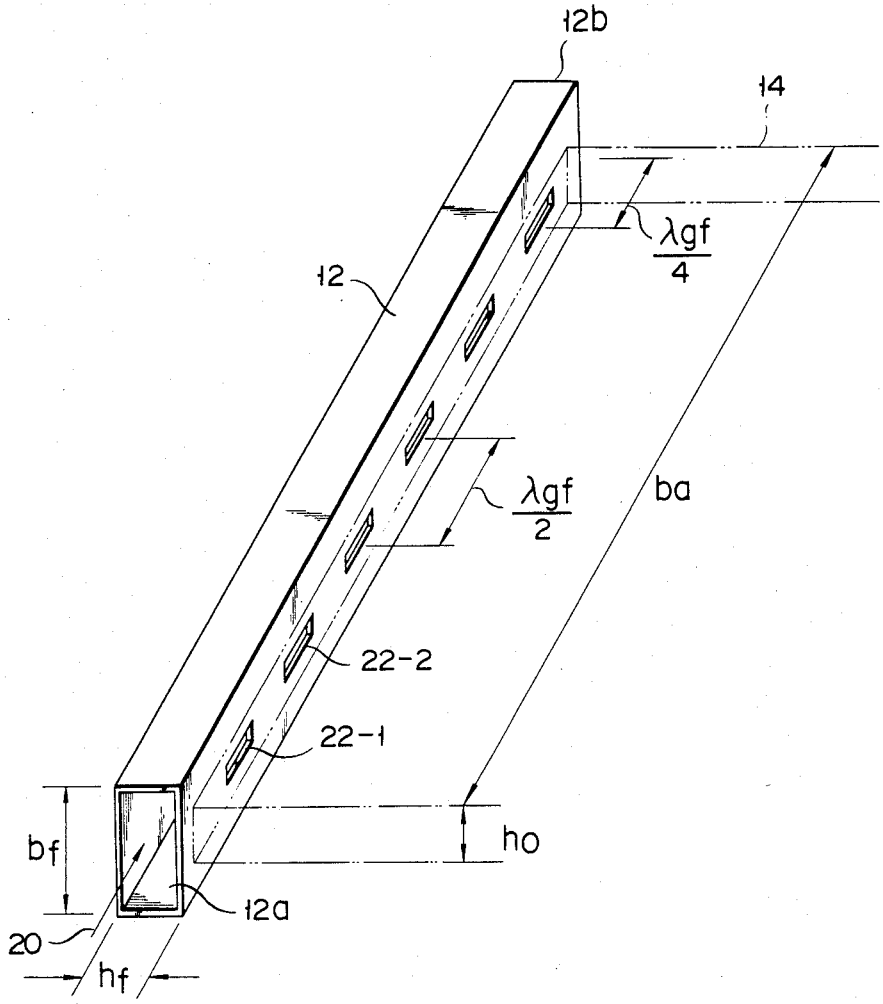
FIG. 2 is a perspective view of a power-feed waveguide included in the planar antenna shown in FIG. 1.

Feed waveguide 12 is constituted by a hollow rectangular metal pipe having width $b_f$ and height $h_f$, as illustrated in FIG. 2 in detail. One end 12*a* of waveguide 12 is open to serve as a feed end, and the other end 12*b* thereof is closed, i.e., short-circuited. Waveguide 12 transmits a $TE_{01}$ mode microwave along its longitudinal direction as indicated by arrow 20. In this case, cutoff frequency $\lambda_{cf}$ of waveguide 12 is defined by:

$$\lambda_{cf}=2\cdot b_f$$

A broadside array of slots 22-1, 22-2, . . . , 22-n (the suffixes "1", "2", . . . , "n" will be dropped if there is no need to distinguish them from each other in the following description) are formed in one side surface (known as an H surface) of waveguide 12. Here the centers of successive slots 22 are spaced a half guide wavelength $\lambda_{gf}$ apart as shown in FIG. 2 as "$\lambda_{gf}/2$". The $TE_{01}$ mode microwave input to waveguide 12 through feed end 12*a* propagates through slots 22 toward the inside of planar waveguide 14 with patch array 18.

Figure 3:
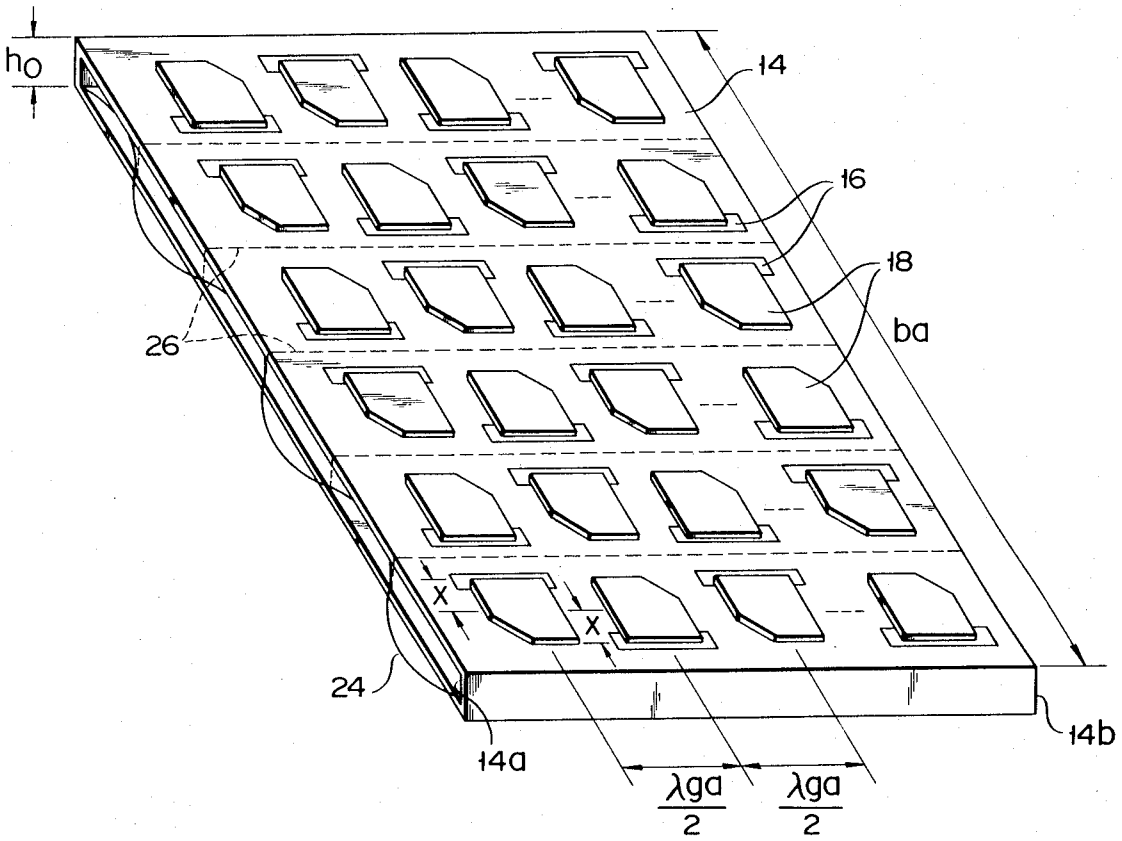
FIG. 3 is a perspective view of the waveguide of the planar antenna shown in FIG. 1, the waveguide having the radiator plates electromagnetically coupled with narrow slots cut in the upper surface thereof.

Array waveguide 14 is constituted by a wide, thin, rectangular metal tube having width $b_a$ and height $h_0$, as illustrated in FIG. 3 in detail. Coupling end portion 14*a* of array waveguide 14 is open as shown in FIG. 3, and end portion 14*b* opposite thereto is completely closed, i.e., short-circuited. Microwaves transmitted from slots 22 of waveguide 12 through open end portion 14*a* of waveguide 14 propagate toward closed end portion 14*b* as a $TE_{0n}$ mode (higher mode) microwave. FIG. 3 illustrates a case wherein n=6 (i.e., the number of slots 22 is 6). In this case, the $TE_{06}$ mode microwave is indicated by solid sin curve 24.

Array waveguide 14 is equivalently considered to be divided into a plurality of rows of rectangular waveguide components by electric walls (parallel to the propagating direction of microwaves in waveguide 14) indicated by broken lines 26 in FIG. 3. The width of each waveguide component row corresponds to a wavelength half a guide wavelength ($\lambda_{ga}$) (i.e., $\lambda_{ga}/2$). Therefore, waveguide 14 is equivalent to an arrangement in which a plurality of (n) rectangular waveguide components, each having width $\lambda_{ga}/2$ and height $h_0$ are aligned parallel to each other. It should be noted that the phases of $TE_{06}$ mode microwaves propagating through the two adjacent rectangular waveguide components are shifted through 180° from each other, as can be understood from solid sin curve 24 indicating the $TE_{06}$ mode microwave in FIG. 3. This is associated with the positions of narrow slots 16 formed in waveguide 14 and the excitation phases of patch radiators 18.

Each row of narrow slots 16, i.e., narrow slots 16 formed in each rectangular waveguide component are aligned in a zigzag manner. In other words, alternate slots 16 are on opposite sides of the center line of the upper surface of each waveguide component, and the distance between the opposing slots is constant. The zigzag patterns of the two neighboring rows of slots 16 are line-symmetrical with each other. Therefore, slots 16 on the two waveguide components neighboring through electric wall 26 are arranged in a mirror-like manner, as illustrated in FIG. 3. A pitch between slots 16 in the microwave propagating direction of each row of narrow slots 16 (i.e., in the axial direction of each waveguide component) is selected to be half the guide wavelength ($\lambda_{ga}$) (i.e., $\lambda_{ga}/2$).

Figure 4:
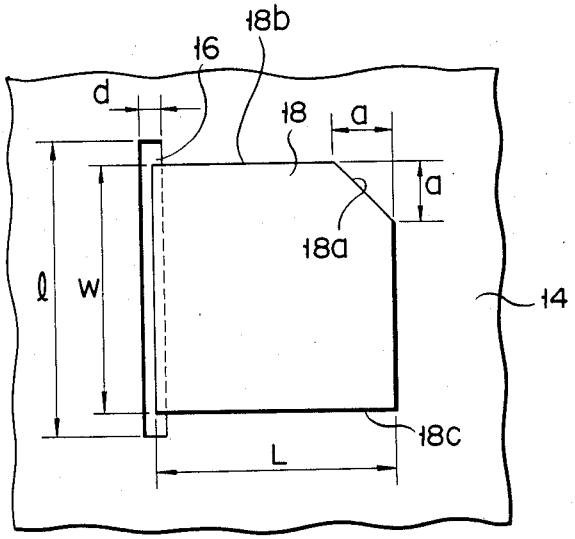
FIG. 4 shows in plan an extended view of a narrow slot and a radiator plate coupled therewith on the waveguide for radiation/reception of microwaves.

Patch radiators 18 are arranged on array waveguide 14 to be coupled to the corresponding slots 16 arranged in the zigzag manner, thereby forming a two-dimensional radiator array. The coupling condition between slot 16 and patch radiator 18 is apparent from the partial plan view of waveguide 14 in FIG. 4. In this embodiment, if the length of one slot 16 formed on the surface of waveguide 14 is given by l, patch radiator 18 is constituted by a W×L rectangular thin metal plate. The size of all the slots 16 is the same and that of all the radiators 18 is also the same. Patch radiator 18 is arranged to partially overlap the corresponding slot 16. A triangular chip portion, in which the length of each of two sides forming a right angle therebetween is a, is cut from rectangular patch radiator 18. The coupling condition between slot 16 and patch radiator 18 changes depending on the overlapping area therebetween . Referring to FIG. 4, slot 16 and radiator 18 overlap each other by an area half the width of slot 16.

Figure 5:
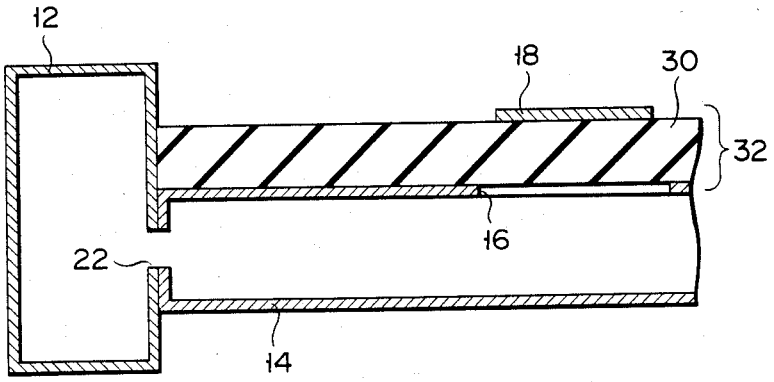
FIG. 5 is a partly sectional fragmentary schematic illustration of the planar antenna of FIG. 1 along lines V—V to show the coupling condition between the power-feed waveguide and the waveguide with the radiator plates of the planar antenna.

FIG. 5 is a partial sectional view of the antenna of this embodiment, best showing the coupling condition between slot 16 and patch radiator 18 of waveguide 14 (not drawn to scale). FIG. 5 best illustrates a state wherein waveguides 12 and 14 are coupled through slots 22. Patch radiators 18 are arranged on insulative layer 30 (layer 30 is omitted from FIGS. 1, 3 and 4 for the sake of simplicity) formed on the upper surface of waveguide 14 to satisfy the overlap condition with slots 16.

With this embodiment, patch radiator 18 arrays are formed by using pattern-printed board 32 sandwiching insulative layer (or insulative substrate ) 30 between two, uppper and lower metal plate layers. More specifically, when the metal plate layers on pattern-printed board 32 are etched by a known photolithography technique, slot 16 arrays and patch radiator 18 arrays can be easily formed on two surfaces of board 32 with high precision. The side walls and the bottom portion of waveguide 14 can be realized by mounting appropriate metal plates by, e.g., welding.

Referring again to FIG. 3, patch radiators 18 are aligned on waveguide 14 so that their cutaway portions 18*a* are alternately directed in different directions. This alignment of radiators 18 is necessary for obtaining the same rotational direction of circularly polarized microwaves radiated from radiators 18 and for cophasing them. In order to satisfy this requirement, with the antenna of this embodiment, the pitch in each row of slots 16 is selected to be half guide wavelength $\lambda_{ga}$ (i.e., $\lambda_{ga}/2$), and cutaway portions 18*a* of radiators 18 are alternately directed in different directions rotated through 180°. As a result, the circularly polarized microwaves radiated from radiators 18 are cophased in a direction perpendicular to the patch radiator alignment surface of waveguide 14, and are correctly rotated in the same direction.

In addition, when the $TE_{0n}$ mode microwave supplied from waveguide 12 to waveguide 14 propagates through the interior of n equivalent rectangular waveguide components (n=6 in this embodiment) divided by the electric walls 26, as described above, the phases of propagating microwaves in two neighboring equivalent rectangular waveguide components are different from each other by 180°. Therefore, in order to compensate for this, each row of patch radiator array (i.e., patch radiators 18 aligned in the axial direction of each equivalent rectangular waveguide component) is arranged such that their cutaway portions 18*a* are alternately directed in different directions rotated through 180°. Since the above patch radiator alignment is adopted, circularly polarized microwaves, which are rotated in the same direction and are cophased, can be radiated from the radiators of the antenna of this embodiment.

It is often preferred that the excitation amplitudes of the circularly polarized microwaves from radiators 18 have a uniform distribution or a tapered distribution, as well as they are rotated in the same direction and are cophased. To satisfy this requirement, the distribution of the excitation amplitudes can be determined by a distance indicated by x in FIG. 3 (i.e., a distance between the axial center of each rectangular waveguide component and the center of slot 16). For example, if distance x increases, the excitation amplitude increases. On the contrary, if distance x increases, patch radiators 18 are not aligned in a line but arranged in a zigzag form. This technique can be applied to adjust the coupling from slots 22 of waveguide 12 to 14.

With the planar antenna according to the embodiment of the present invention, when a circularly polarized microwave is radiated, no wire lines or no microstrip lines are used for propagating microwaves from a microwave source to patch radiators 18. More specifically, microwave propagation to waveguide 14 is performed by waveguide 12. Microwave propagation between slots 16 and radiators 18 of waveguide 14 is performed through thin insulative layer 30. In other words, radiators 18 are excited directly by slots 16. Therefore, a microwave loss during power feeding can be minimized, thereby improving the aperture efficiency of the antenna. For example, when power is fed through wire lines, a 12-GHz microwave is attenuated by about 4 dB per 1-m wire line. In contrast to this, when waveguide 12 is used, the microwave attentuation rate is very low (i.e., about 0.1 dB/m).

In addition, with the antenna of the present invention, the generation of grating lobes in a radiation pattern of the circularly polarized microwave can be satisfactorily suppressed without using a slow-wave circuit necessary in the conventional radial-line slot-array type planar antenna. The reason for this is as follows. Special-purpose patch radiators 18 are provided to the corresponding slots 16 formed in waveguide 14. With this arrangement, in order to suppress the generation of grating lobes, an alignment spacing between radiators must be minimized since the generation of grating lobes depends on this spacing. According to the present invention, in each patch radiator 18, two open boundary planes 18*b* and 18*c* perpendicular to slot 16 act as a local radiator. In the patch radiation array, the distance between the open boundary planes serving as the local radiator extending perpendicular to narrow slots 16 can be smaller than free-space wavelength $\lambda_0$ (the present inventors confirmed a case wherein it was decreased to $0.7\lambda_0$) with respect to the whole radiator array shown in FIG. 1. The same argument may be also applied to the distance between open boundary planes extending parallel with narrow slots 16. Thus, the alignment spacing of the radiators of the antenna can be effectively decreased, and the generation of grating lobes can be suppressed. As a result, a well circularly polarized microwave having an excellent directivity can be obtained at a maximum efficiency without requiring any additional circuitry (e.g., a slow-wave circuit).

Figure 6:
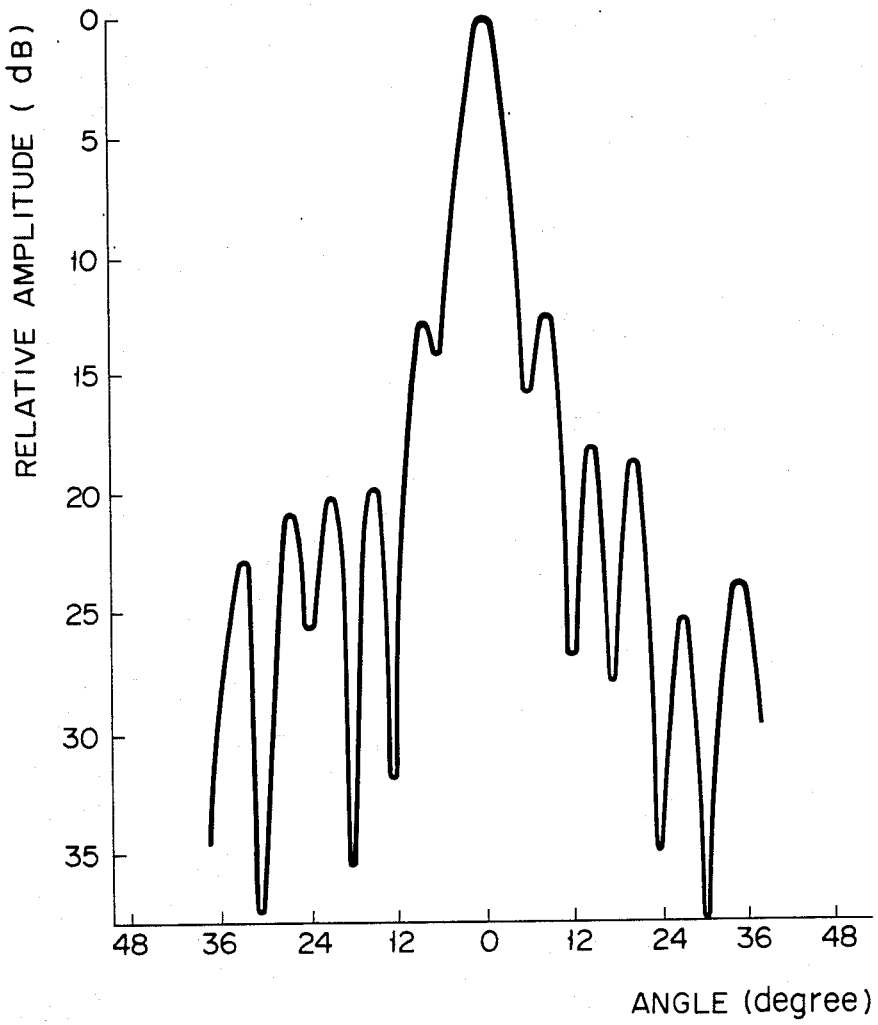
FIG. 6 is a graph showing the actually measured radiation pattern of the planar antenna in accordance with one embodiment of the invention.

In order to demonstrate the above effect, the present inventors prepared a 14-element antenna having the basic arrangement shown in FIG. 1. In this antenna, for 12-GHz microwave radiation, width $b_a$ and height $h_0$ of array waveguide 14 were respectively set to be 17.677 mm, and 10 mm. In this case, the size of each patch radiator 18 was W=L=7.1 mm, and length a of cutaway portion 18*a* was 1.9 mm. In each slot 16, width d and length l were respectively set to be 0.2 mm and 7.1 mm, and distance x from the central axis of each rectangular waveguide component was set to be 8.3 mm. A test operation was conducted using this antenna, and its aperture efficiency, radiation pattern and axial ratio were measured. As a result, a good aperture efficiency of 65% was obtained. The measured radiation pattern of right circularly polarized wave is as shown in FIG. 6. As can be seen from the measured radiation pattern, in the circularly polarized microwave radiated from the antenna, the generation of grating lobes can be satisfactorily suppressed. The axis ratio was measured to be 0.5 dB, which shows an excellent circularly polarized microwave characteristic.

Since each patch radiator 18 is excited directly by the corresponding slot 16 through insulative layer 30, the coupling condition between slots 16 and radiators 18 on waveguide 14 can be accurately set, and the manufacture of waveguide 14 can be simplified. This is because the insulative substrate sandwiched between two metal layers can be etched by photolithography to form alignment patterns of slots 16 and patch radiators 18 at the same time. Therefore, the mounting step of patch radiators 18 on waveguide 14, which is necessary in the conventional planar antenna, can be omitted. This means a high-performance antenna can be realized with a low manufacturing cost, resulting in great practical advantages for antenna manufacturers.

Figure 7:
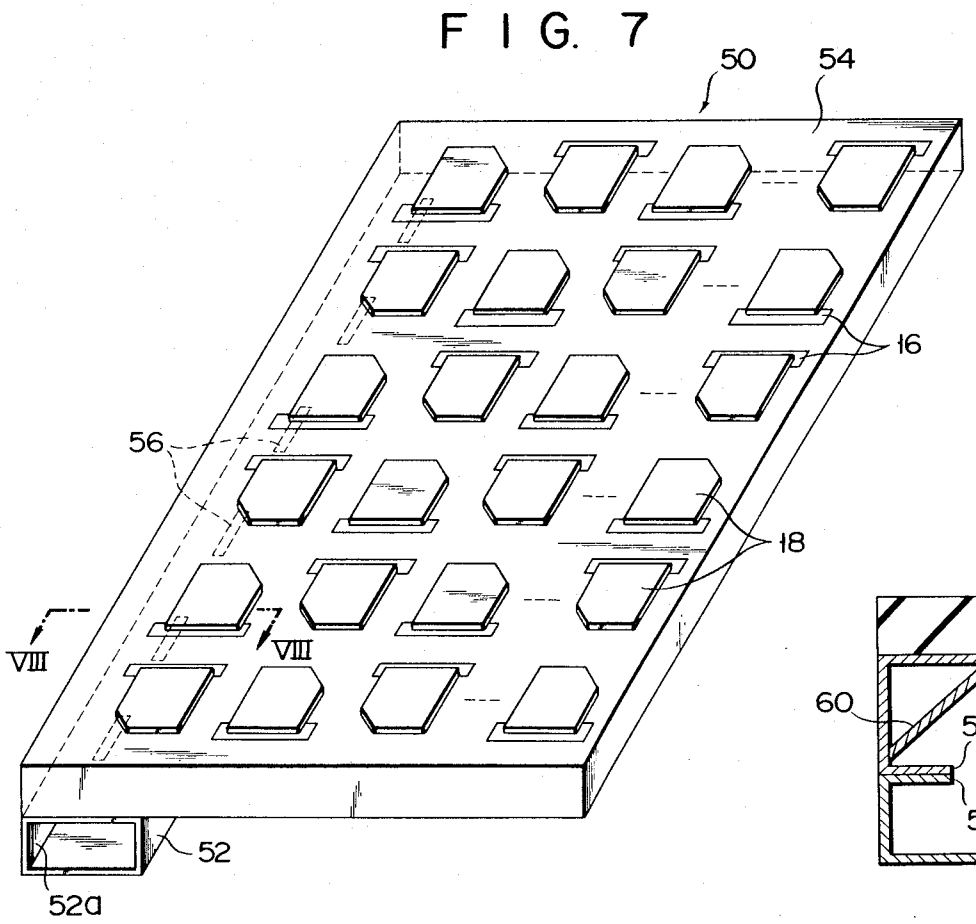
FIG. 7 is a perspective view of a planar antenna with radiator arrays formed on a wide rectangular waveguide for radiation/reception of microwaves, in accordance with a second embodiment of the present invention.

A planar antenna according to a second embodiment of the present invention will now be described with reference to FIG. 7. The same reference numerals in the antenna shown in FIG. 7 denote the same parts as in the first embodiment, and a detailed description thereof will be omitted. With this embodiment, rectangular waveguide 52 serving as a power-feed waveguide is coupled to the lower plate of wide, thin planar waveguide 54, which has a plurality of rows of narrow slots 16 and patch radiators 18 electromagnetically coupled thereto. Planar waveguide 54 has no open end face. In this case, microwave propagation between waveguides 52 and 54 is performed through a row of narrow slots 56 cut in the lower plate of waveguide 54. The number of slots 56 is the same as that of equivalent parallel waveguide components divided by electric walls in array waveguide 54, as in the first embodiment shown in FIG. 1.

Figure 8:
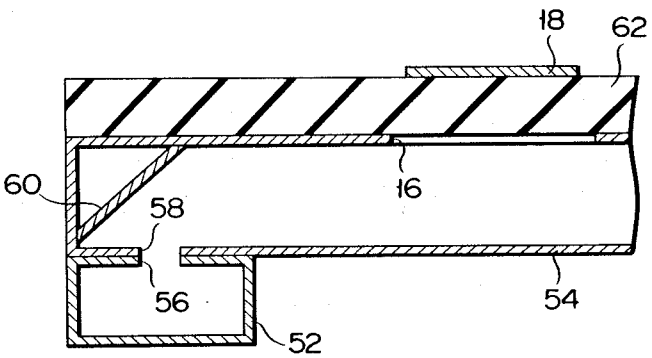
FIG. 8 is a partly sectional fragmentary schematic illustration of the planar antenna of FIG. 7 along lines VIII—VIII to show the coupling condition between a power-feed waveguide and a waveguide with the radiatior plates provided in the planar antenna shown in FIG. 7.

Waveguide 52 is open at its one end portion, and is closed (i.e., short-circuited) at the other end portion thereof. FIG. 7 illustrates power-feed waveguide 52 which has six microwave supply slots 56 in one surface thereof. Array waveguide 54 also has slots 58 in its lower plate corresponding in number to slots 56. Slots 58 are arranged to coincide with slots 56. The coupling condition between a corresponding pair of slots 56 and 58 is best illustrated in the partial sectional view of FIG. 8. Therefore, a microwave supplied from microwave supply end 52*a* of waveguide 52 is guided to the inside of waveguide 54 through each pair of slots 56 and 58. It should be noted that waveguide 54 incorporates reflection plate 60, thus effectively allowing the microwave to propagate between waveguides 52 and 54. As shown in FIG. 8, reflection plate 60 is mounted inside waveguide 54 to oppose the array of slots 58 and to be inclined at about 45° with respect to the inner edge of waveguide 54.

Insulative layer 62 having a honeycomb structure is arranged to cover slots 16 formed in the upper plate of waveguide 54 in the same manner as in the first embodiment. Patch radiators 18 are arranged on the surface of insulative layer 62 opposite slots 16 to be excited directly by the corresponding slots 16. The electromagnetical coupling condition between slots 16 and patch radiator 18 is the same as in the first embodiment.

When the above antenna structure is adopted, since projection of waveguide 52 from waveguide 54 can be minimized, the outer shape of the slot antenna can be compact without impairing the effect of the present invention, which provides an improvement of the basic characteristics of the antenna (i.e., an improvement of an aperture efficiency and a microwave directivity). Since insulative layer 62 interposed between slots 16 and patch radiators 18 has a honeycomb structure, a dielectric loss in microwave propagation can be reduced.

Although the invention has been described with reference to a specific embodiment, it shall be understood by those skilled in the art that numerous modifications may be made that are within the spirit and scope of the inventive contribution.

Various practical modifications of alignment of patch radiators on the array waveguide of the planar antenna may be made. For example, in the above embodiment, single patch radiator 18 is arranged on each slot 16. However, the present invention is not limited to this, and each slot can simultaneously excite a plurality of patch radiators. In accordance with the type of microwave transmitted/received by this slot antenna, patch radiators 18 can be aligned on the waveguide to be directed in the same direction.

In addition, in the above embodiments, waveguide 54 on which a plurality of rows of patch radiators 18 are formed is divided by electric walls 26 into a plurality of equivalent parallel rectangular waveguide components. Some or all of these electric walls can be replaced with metal partition plates. With this arrangement, the mechanical strength of wide, thin waveguide 14 or 54 can be improved.

What is claimed is:

1. A planar antenna comprising:

(a) feeder means for transmitting a microwave radiation, said feeder means comprising a first slotted waveguide; and (b) antenna means for sending a circularly polarized microwave out into space, said antenna means comprising a second slotted waveguide of planar type coupled with said first slotted waveguide, said second slotted waveguide having, a conductive plate in which a two-dimensional slot array including a plurality of rows of slots are formed, an insulative layer provided on said conductive plate to cover said two-dimensional slot array, and a plurality of rows of plate-shaped radiators provided on said insulative layer, each of said plate-shaped radiators being positioned to at least partially overlap a corresponding slot and electromagnetically coupled with the corresponding slot, each radiator being directly excited by microwave radiation propagating through the corresponding slot through said insulative layer to thereby radiate a circularly polarized microwave.

2. The antenna according to claim 1, wherein said radiators have open boundary planes serving as local radiators whose spacing therebetween in each radiator array is set to be smaller than a free-space wavelength, thereby suppressing the generation of grating lobes in a radiation pattern of said antenna.

3. The antenna according to claim 1, wherein said radiators comprise rectangular conductive plates each of which has a cutaway portion at its one edge portion, said radiators being arranged on said insulative layers to at least partially overlap the corresponding slots.

4. The antenna according to claim 3, wherein said second slotted waveguide is divided by at least one electric wall into parallel waveguide components each having one array of said plate-shaped radiators.

5. The antenna according to claim 3, wherein said second slotted waveguide has an open side surface perpendicular to said plurality of rows of slots, and wherein said first slotted waveguide has an array of second slots aligned along a microwave propagating direction therein in one side surface coupled to said open side surface of said second slotted waveguide, said array of second slots allowing microwave propagation between said first and second slotted waveguides through said array of second slots.

6. The antenna according to claim 3, wherein said second slotted waveguide has an array of second slots in one side surface thereof, and wherein said first slotted waveguide has an array of third slots corresponding to said second slots and aligned along a microwave propagating direction therein in one side surface thereof coupled to said second slotted waveguide, said second and third slots being coupled to each other to allow microwave propagation between said first and second slotted waveguides through said second and third slots.

7. The antenna according to claim 6, wherein said second slotted waveguide comprises:

a second conductive plate which is separated from said conductive plate, on which said insulative layer is stacked, to define a gap therebetween, and in which said third slots are formed; and reflector means which is fixed inside said second slotted waveguide to oppose said third slots and to be inclined with respect to said second conductive plate, and reflects a microwave received in one direction to propagate it in the other direction between said first and second slotted waveguides.

8. A manufacturing method of a planar antenna with patch radiatiors for sending circularly polarized microwaves out into space, said method comprising the steps of:

forming first and second conductive plates on both surfaces of an insulative substrate;

etching said first and second conductive plates by photolithography to form a two-dimensional slot array including a plurality of rows of slots in said first conductive plate and to form, in said second conductive plate, a plurality of rows of plate-shaped patch radiators, each radiator at least partially overlapping a corresponding slot and electromagnetically coupled to the corresponding slot;

mounting a conductive envelope body to said etched first conductive plate, thereby obtaining a planar type array waveguide; and coupling a power-feed slot waveguide, for supplying a microwave to said array waveguide, to said array waveguide.

* * * * *